United States Patent [19]

Graffin

[11] Patent Number: 4,579,156

[45] Date of Patent: Apr. 1, 1986

[54] DEVICE PERMITTING THE CLEANING OF A FILLING HEAD WITHOUT DISMANTLING IT

[75] Inventor: Jean-Jacques Graffin, La Ferte Bernard, France

[73] Assignee: SERAC S.A., La Ferte Bernard, France

[21] Appl. No.: 568,145

[22] Filed: Jan. 4, 1984

[30] Foreign Application Priority Data

Feb. 15, 1983 [FR] France ..... 83 02409

[51] Int. Cl.[4] ..... B67C 3/26

[52] U.S. Cl. ..... 141/89; 134/166 C; 141/85

[58] Field of Search ..... 239/106, 112, 113, 569; 222/148–151; 134/166 C; 141/85, 89–91, 392

[56] References Cited

U.S. PATENT DOCUMENTS

| | | | |
|---|---|---|---|
| 3,964,526 | 6/1976 | Sindermann | 222/148 X |
| 4,137,954 | 2/1979 | Brill et al. | 141/90 |
| 4,396,044 | 8/1983 | Ahlers | 141/90 |

FOREIGN PATENT DOCUMENTS

| | | | |
|---|---|---|---|
| 2824196 | 1/1979 | Fed. Rep. of Germany . | |
| 2290259 | 6/1976 | France | 141/90 |
| 849296 | 9/1960 | United Kingdom . | |
| 1557469 | 12/1979 | United Kingdom | 141/90 |

*Primary Examiner*—Stephen Marcus
*Assistant Examiner*—Ernest G. Cusick
*Attorney, Agent, or Firm*—Cushman, Darby & Cushman

[57] ABSTRACT

The present invention relates to a device permitting the cleaning of at least one filling head (3) containing a movable nonreturn valve (13) adapted to be held in the open position by a control rod (19) carried by a grid carrier sleeve (15), a fixed collector member (4) being disposed around each filling head, each collector member having an opening disposed plumb with the filling head and adapted to receive a closure member (9) having an annular collar (30) adapted to bear against the bottom part of the movable sleeve (15) in order to effect the opening of the valve, while an annular member (26) provides a seal against the inside wall (27) of the collector member (4). The device has application in particular to a turntable for filling by weight.

6 Claims, 3 Drawing Figures

DEVICE PERMITTING THE CLEANING OF A FILLING HEAD WITHOUT DISMANTLING IT

BACKGROUND OF THE INVENTION

The present invention relates to a device permitting the cleaning of at least one filling head without dismantling it.

PRIOR ART

In French Pat. No. 2,290,259 a description has already been given of a process and an apparatus permitting the cleaning of a filling head without dismantling it and without it being necessary to make use of the usual device controlling the opening of the filling head, particularly in order to avoid the heating of the opening control device in the case of an electromagnetically controlled filling head.

In this process the nonreturn valve is opened mechanically by inserting a collector comprising a member adapted to control mechanically the opening of the nonreturn valve and thus making it possible in particular to effect the cleaning of the filling head in the usual direction of flow.

A process of this kind and the corresponding apparatus are quite satisfactory. However, in the case of a turntable, particularly for weight metering, comprising numerous filling heads, it becomes irksome and complex from the point of view of space to provide a collector under each filling head, or even a series of associated collectors, and it therefore appeared desirable to find a device which is easier to operate and takes up less space, while making it possible to serve the dual function of filling in the normal position and holding the movable nonreturn valve in the open position when it is desired to discharge continuously the product contained in the feed hopper of the filling head.

SUMMARY OF THE INVENTION

One object of the present invention is to propose a device which is permanently ready to effect the discharge of the product flowing outside the usual filling function, particularly during cleaning, and which can be brought into the discharge position by a simple operation without substantially affecting the size of the filling heads.

In one embodiment of the present invention each filling head contains a movable nonreturn valve adapted to be held in the open position by a mechanical means, and is also provided with a fixed collector member disposed around the filling head, each collector member having an opening disposed plumb with the filling head and adapted to receive a closure member controlling the opening of the nonreturn valve when the said closure member is placed in position in the opening in the collector.

According to other characteristics of the present invention, the closure member comprises an annular collar which comes to bear against a retractable sleeve disposed in the filling head, the collar having at least one radial opening and the retractable sleeve being provided with a rod controlling the opening of the valve and held by a centering ring disposed in the feed pipe.

According to another more particular characteristic, the closure member has an annular seal cooperating with the inside wall of the collector associated with it, and each closure member is mounted on the associated collector by means of bayonet devices adapted to turn freely on the closure member.

Finally, according to the invention the various collector members can be connected together by a discharge pipe joining the different collector members and leading into a single discharge aperture.

BRIEF DESCRIPTION OF THE DRAWINGS

Other characteristics and advantages of the present invention will emerge from the following description given in conjunction with the accompanying drawings, in which.

DETAILED DESCRIPTION OF THE DRAWINGS

Figure 1:
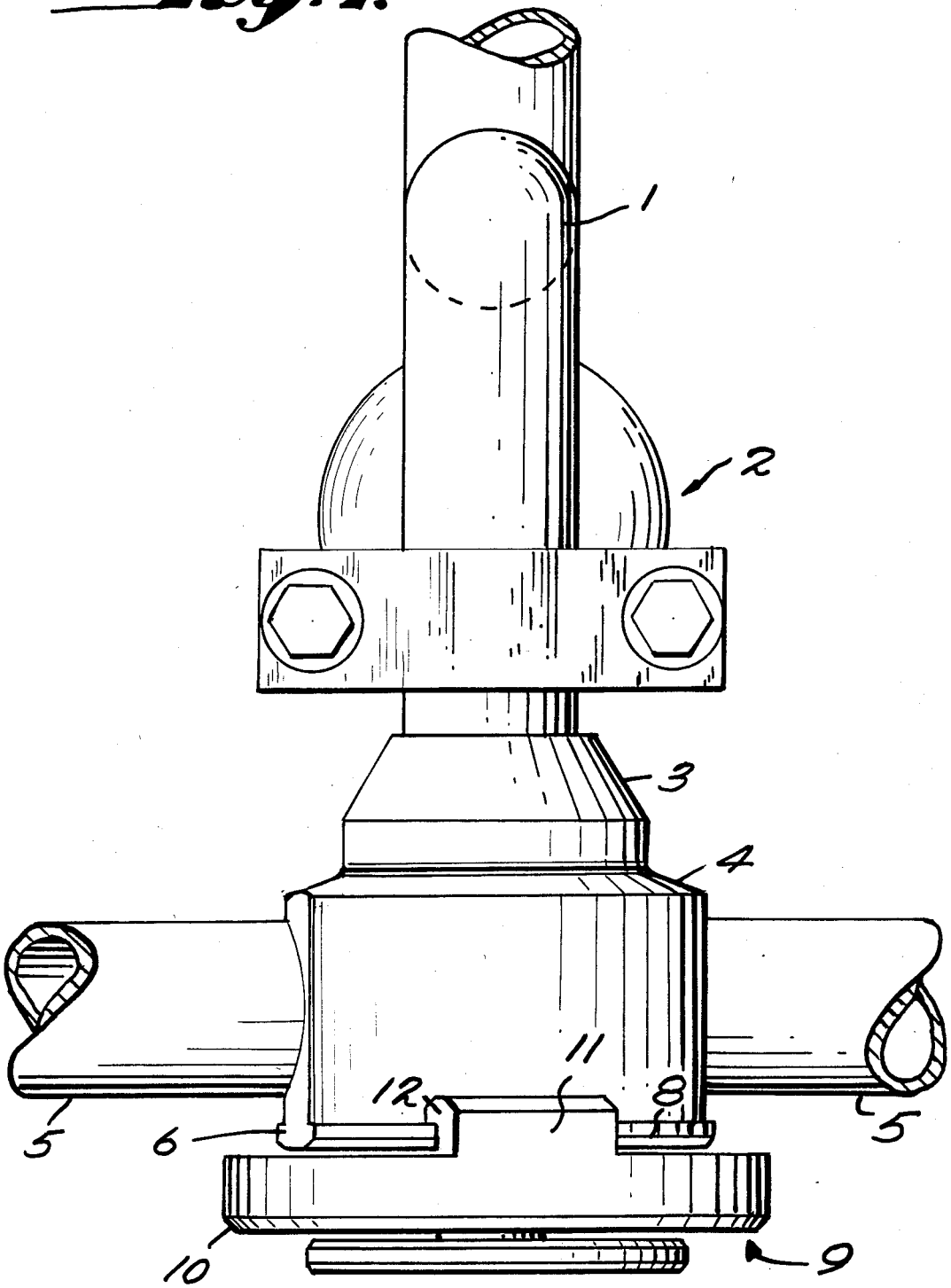
FIG. 1 is a front view of the device according to the invention, with the closure member placed in position, while the filling head is also provided with an electromagnetic filling control device.
Figure 3:
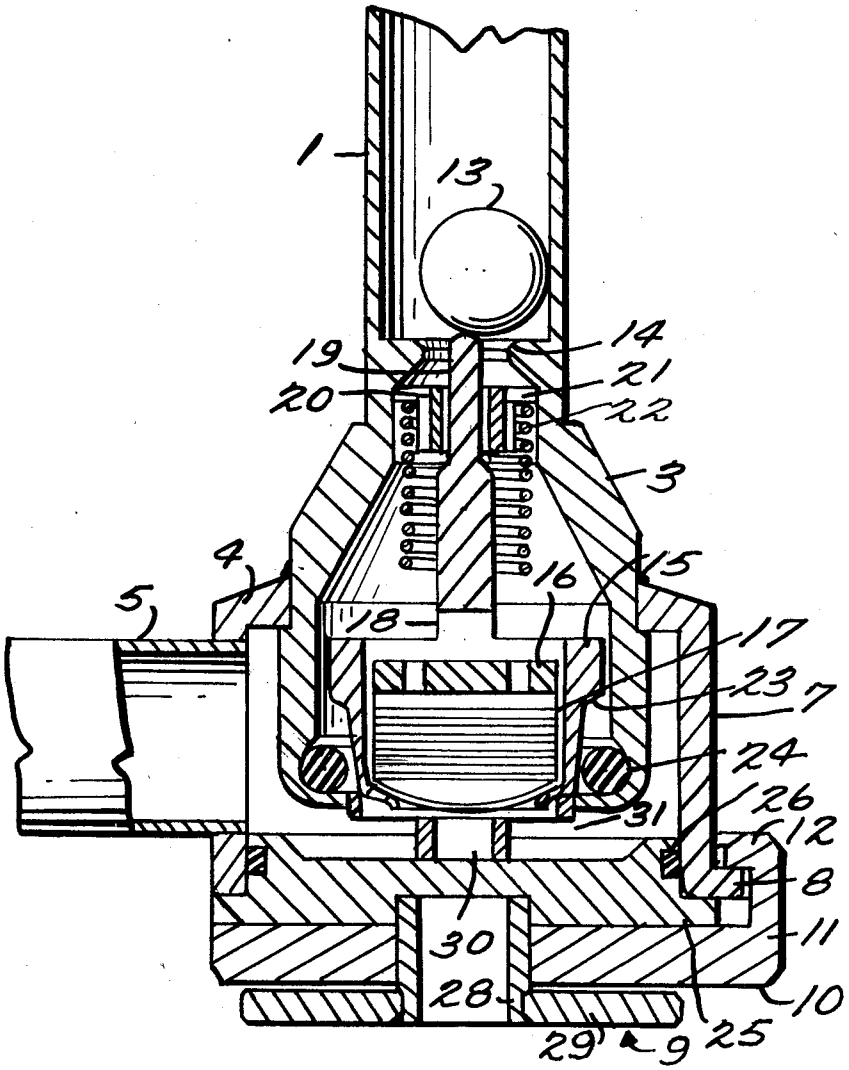
FIG. 3 is a view similar to FIG. 2 but showing the filling head in the open position.

Referring to FIG. 1, the device according to the invention comprises a feed pipe 1, on which is mounted an electromagnetic control means 2 known per se. At the end of the feed pipe 1 is fixed a filling head body 3 surrounded over part of its height by a collector member 4 serving as an enclosure means, on which are fixed discharge pipes 5 leading into an internal cavity in the collector member.

The outer wall of the collector member for enclosure means 4 has flat parts 6 joined by substantially cylindrical walls 7 provided with a rim 8.

The closure member 9 comprises a movable ring 10 provided, symmetrically relative to the axis of the filling head, with arms 11, each of which ends in a tooth 12 adapted to cooperate with the rim 8.

Figure 2:
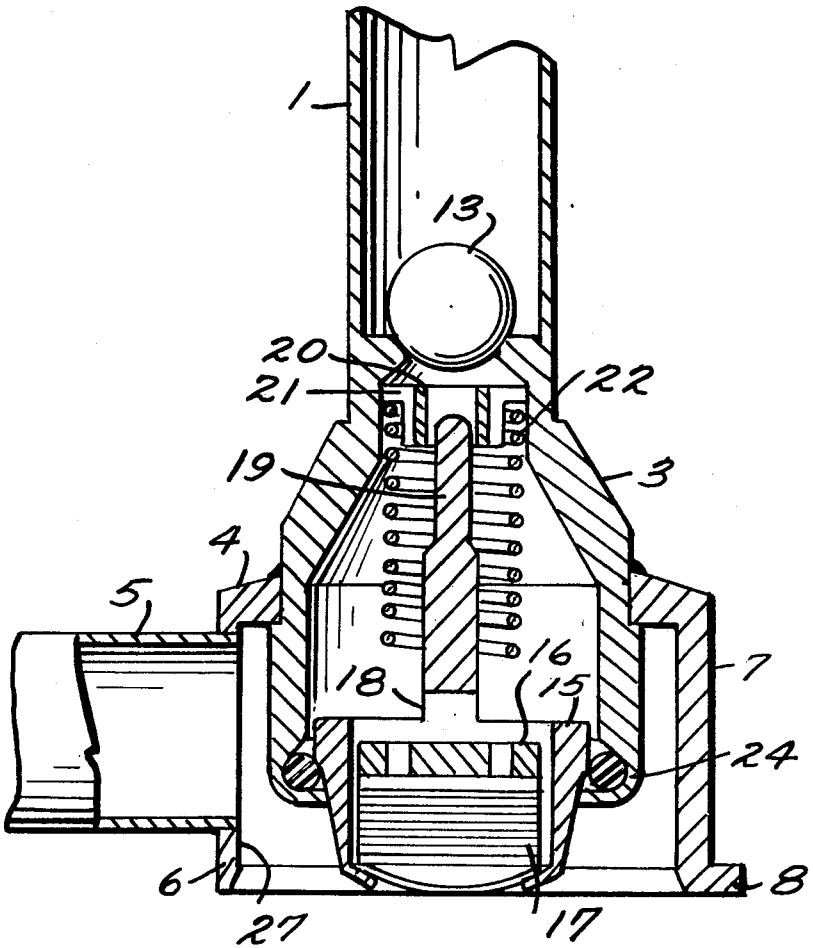
FIG. 2 is a sectional view in elevation of the device of FIG. 1 showing the filling head in the closed position.

Referring now to FIG. 2, it can be seen that the filling head contains a nonreturn valve in the form of a ball 13 adapted to cooperate with a valve seat 14. Inside the filling head, which has a substantially circular section, is disposed a retractable grid carrier sleeve 15 supporting a barrel 16 and a series of foam inhibitor grids 17. The sleeve also comprises a substantially diametrical bow 18 extended at the top by a substantially axial control rod 19 extending into a centering ring 20 provided with radial fins 21 forming a stop for a return spring 22 held in compression between the radial fins 21, on the one hand, and the substantially horizontal top surface of the bow 18.

The outer surface of the retractable sleeve 15 is in addition provided with a shoulder 23 which, in the normal operating position of the filling head, comes to bear against an annular seal 24 disposed in an internal groove at the end of the filling head.

The closure member 9 comprises a substantially circular body 25 having on its periphery an annular seal 26 cooperating with the substantially cylindrical inside wall 27 of the collector member 4.

A connecting member 28 is fixed on the bottom part of the body 25 of the closure member and carries a fixed end disk 29, thus forming a space between the body 25 of the closure member and the disk 29, wherein the movable ring 10 is disposed.

At the top, the body of the closure member 25 has an annular collar 30, whose top rim comes to bear against the bottom end of the movable sleeve 15 on insertion of the closure member into the inside cavity of the collector member. The collar 30 is provided with radial apertures 31.

In connection with the left-hand part of FIG. 2, it can be seen that during normal utilization of the filling head the valve 13 resets normally on its seat, from which it can be lifted by the appropriate customary filling control means, the control rod 19 being held away from the nonreturn valve by the spring 22, which at the same time maintains a seal between the retractable sleeve 15 and the filling head body by firmly pressing the sleeve 15 against the annular seal 24. On operation of the valve opening control means, the product contained in the feed pipe can thus flow between the fins 21 of the centering ring 20, and then through the grid carrier sleeve 15 to the container disposed under the filling head.

When it is desired to hold the nonreturn valve in the open position without making use of the usual control means, for example for cleaning in the direction of flow, as indicated in French Pat. No. 2,290,259, the arms 11 of the bayonet device of the closure member are placed opposite the flats 6, and the body 25 of the closure member can then penetrate into the cavity of the collector element 7. The ring 10 is then turned so that the teeth 12 come to coincide with the rim 8, and the closure member is thus held in position.

When the closure member penetrates into the cavity in the collector member 7, the collar 30 pushes the bottom end of the sleeve 15, which, by means of its control rod 19, brings about the opening of the nonreturn valve 13.

The product held in the feed column 1 then flows on the one hand through the grid carrier sleeve and the apertures 31, and on the other hand around the grid carrier sleeve, between the latter and the inside wall of the filling head, and is then discharged through the discharge pipes 5 to the outlet aperture (not shown) of these pipes.

It will be understood that the device according to the invention can be used in conjunction with different types of filling heads. In particular, for filling heads which do not have a grid carrier sleeve, it would be possible to conceive a control rod mounted directly on the body of the closure member, so that on insertion of the closure member into the cavity in the collector member the nonreturn valve is held in the open position.

Similarly, the collector member may have only one discharge pipe, connected direct to a container. Finally, the closure member may be held in position by any suitable arrangement.

Moreover, in connection with FIG. 2 it will be noted that the vertical wall 6,7 of the collector member 4 extends downwards to a level at least equal to that of the bottom edge of the filling spout (here the sleeve 5) in its normal position of use, so that the bottom edge of the spout is preferably set back and is at most in the same plane as the edge of the opening of the collector member. Thus, the collector member serves as a hood protecting against risks of external pollution by manual contact or in any other way. This characteristic may be important in the case of aseptic filling operating in a sterile atmosphere. It is in fact imperative that the sterilization effected during cleaning should not be destroyed during subsequent manipulations.

The present invention is not limited to the examples of embodiment which have been described above, but on the contrary is capable of modifications and variations which will be accessible to those versed in the art.

I claim:

1. A filling head for filling bottles with liquid of the type having a non-return valve and mechanical means for opening said valve, said filling head including a body, means for facilitating cleaning of said filling head, said filling head body having an open bottom, a sleeve mounted for movement between a forward and a retracted position, said sleeve, when in said retracted position, functioning to open said valve and, when in said forward position, allowing said valve to close, said means for facilitating cleaning of said filling head including an enclosure means for said head having an open bottom and a peripheral wall having a rim with said enclosure means defining an annular space and including a laterally disposed discharge pipe communicating with said annular space, said means for facilitating cleaning further including a closure member adapted to be tightly joinable to said rim to close said bottom opening of said enclosure means while opening said valve means to permit discharge of fluid through said filling head to said discharge pipe.

2. The device as claimed in claim 1 wherein said filling head has a bottom edge which is set back relative to said rim of said enclosure means.

3. A device as claimed in claim 1, wherein the closure member comprises an annular collar (30) which comes to bear against a retractable sleeve (15) disposed in the filling head, the collar having at least one radial discharge opening (31).

4. The device as claimed in claim 1 wherein at least one collector member is provided which is conneccted to said discharge pipe.

5. A device as claimed in claim 4, wherein the closure member (9) is mounted on the rim by means of a bayonet device (8, 12).

6. A device as claimed in claim 5, wherein the bayonet device comprises a movable ring (10) adapted to turn freely on the closure member.

* * * * *